US009479870B2

(12) United States Patent
Stamatopoulos

(10) Patent No.: US 9,479,870 B2
(45) Date of Patent: Oct. 25, 2016

(54) PASSIVE LOUDSPEAKER MULTIPLEXER

(71) Applicant: Ioannis Stamatopoulos, Korinthos (GR)

(72) Inventor: Ioannis Stamatopoulos, Korinthos (GR)

( * ) Notice: Subject to any disclaimer, the term of this patent is extended or adjusted under 35 U.S.C. 154(b) by 565 days.

(21) Appl. No.: 13/946,109

(22) Filed: Jul. 19, 2013

(65) Prior Publication Data

US 2014/0023207 A1 Jan. 23, 2014

(30) Foreign Application Priority Data

Jul. 19, 2012 (EP) ..... 12177146

(51) Int. Cl.
*H04R 3/12* (2006.01)
*H04R 1/40* (2006.01)

(52) U.S. Cl.
CPC ..... *H04R 3/12* (2013.01); *H04R 1/403* (2013.01)

(58) Field of Classification Search
CPC ..... H04R 1/403; H04R 3/12
USPC ..... 381/99, 182, 59, 55, 120; 181/144
See application file for complete search history.

(56) References Cited

U.S. PATENT DOCUMENTS 2,802,054 A 8/1957 Corney
3,457,370 A 7/1969 Boner
6,961,438 B1 * 11/2005 Fujita ..... H04R 1/403 181/144

FOREIGN PATENT DOCUMENTS

JP 2008259104 A 10/2008

* cited by examiner

*Primary Examiner* — David Ton
(74) *Attorney, Agent, or Firm* — Bryan W. Bockhop; Bockop Intellectual Property Law, LLC

(57) ABSTRACT

A passive loudspeaker multiplexer (1) adapted to be interconnected between an amplifier (2) and a plurality of loudspeakers (24-32), includes two input ports (4, 6) adapted to be connected to the output ports (2*a*, 2*b*) of an amplifier (2); two output ports (20, 22) adapted to be connected to the input ports of a plurality of loudspeakers (24-32) such that the plurality of loudspeakers are connected in parallel to the output ports; at least one first capacitor (8, 10) connected between a first input port (4) and a first output port (20); a first high pass (16, 18) connected between the output ports.

13 Claims, 4 Drawing Sheets

2Ω Load without circuit

| Uopen [V] | Uload [V] | I [A] | F [Hz] | Zo [Ω] | Zo [Ω] |
|---|---|---|---|---|---|
| 1 | 0,891 | 0,469 | 100 | 0,23240938 | 1,89978678 |
| 1 | 0,891 | 0,454 | 1000 | 0,24008811 | 1,96255507 |
| 1 | 0,891 | 0,416 | 20000 | 0,26201923 | 2,14182692 |

Fig. 3a

2Ω Load with circuit

| Uopen [V] | Uload [V] | I [A] | F [Hz] | Zo [Ω] | Zo [Ω] |
|---|---|---|---|---|---|
| 1 | 0,902 | 0,453 | 100 | 0,21633554 | 1,99116998 |
| 1 | 0,902 | 0,435 | 1000 | 0,22528736 | 2,07356322 |
| 1 | 0,902 | 0,4 | 20000 | 0,245 | 2,255 |

Fig. 3b 0.47 Ω with circuit

| Uopen [V] | Uload [V] | I [A] | F [Hz] | Zo [Ω] | Zo [Ω] |
|---|---|---|---|---|---|
| 1 | 0,706 | 1,284 | 100 | 0,22897196 | 0,54984424 |
| 1 | 0,706 | 1,33 | 1000 | 0,22105263 | 0,53082707 |
| 1 | 0,706 | 1,24 | 20000 | 0,23709677 | 0,56935484 |

Fig. 3c

PASSIVE LOUDSPEAKER MULTIPLEXER

CROSS-REFERENCE TO RELATED APPLICATION(S)

This application claims the benefit of EP Patent Application No. EP12177146.3, filed Jul. 19, 2012, the entirety of which is hereby incorporated herein by reference.

BACKGROUND OF THE INVENTION

1. Field of the Invention

The present invention relates to a passive loudspeaker multiplexer to which a plurality of loudspeakers may be connected in parallel. Particularly, a plurality of different loudspeaker systems may be connected in parallel to an amplifier using the passive loudspeaker multiplexer according to the present invention.

2. Description of the Related Art

It is known that the number of loudspeakers and the resulting impedance connected to an amplifier is crucial in terms of matching the amplifier to a multi loudspeaker system. Most amplifiers cannot operate safely with loads having an impedance lower than 4Ω. Only few amplifiers can operate with a load of 2Ω. This is a major limitation when a considerable amount of loudspeakers have to be connected to an amplifier. Amplifier systems having an output voltage of 100 V are designed to distribute power to multiple speakers from a single amplifier. For several years these 100 V systems have been the only way to match a plurality of loudspeakers to an amplifier.

Further, resistive based impedance matching is known. Such systems typically consist of a network of resistors that are switched to the required configuration through a dial or switches. This requires a manual setting of the correct configuration based on the number of connected speakers.

Also transformer based impedance matching is known. Such impedance matching typically consists of using a transformer to provide the impedance matching. Mostly over some range this may be achieved dynamically without requiring to manually select the correct settings. However, such transformer introduces a power loss due to inefficiencies and possible distortions.

As an alternative an active design may be used to achieve an impedance matching. Active circuits allow detecting the speakers connected to such device. The required impedance matching circuit is activated by a resistive impedance matching or transformer based impedance matching.

U.S. Pat. No. 8,150,074 discloses an example of a manual resistive impedance matching.

However, the prior art has significant disadvantages. For example, resistive based impedance matching requires selecting the number of connected speakers via a dial. When using speaker cabinets with mixed impedances a wrong selection of the required settings may frequently occur. Transformer based designs typically introduce a power loss and distortions. Active designs require an external power supply and tend to be overly complex presenting more opportunities for failure. Further, active designs are not cost efficient.

Accordingly, it is an aspect of the present invention to provide a loudspeaker multiplexer that overcomes the limitations of the prior art.

SUMMARY OF THE INVENTION

The passive loudspeaker multiplexer is adapted to be interconnected between an amplifier and a plurality of loudspeakers. The passive loudspeaker multiplexer comprises two input ports adapted to be connected to the output ports of an amplifier. Further, the passive loudspeaker multiplexer comprises two output ports adapted to be connected to the input ports of a plurality of loudspeakers such that the plurality of loudspeakers is connected in parallel to the output ports. The passive loudspeaker multiplexer comprises at least one capacitor connected between a first input port and a first output port. A first high pass of the passive loudspeaker multiplexer is connected between the output ports.

Such passive loudspeaker multiplexer can handle an arbitrary number of connected speakers without requiring manual configuration of the settings of the device and multiplexer, respectively. The passive loudspeaker multiplexer has a passive design which is thus relatively cost-effective and highly reliable when compared to more intricate active systems, such as a speaker system operating at 100 V. An almost unlimited number of speakers in any configuration may be connected to the output of the amplifier. The passive loudspeaker multiplexer according to the present invention eliminates all mismatching issues such as poor sound quality and amplifiers shutting off due to protection circuits triggering because the overall impedance of the load is too small. Since the passive loudspeaker multiplexer according to the present invention is a fully passive design it does not require an external power supply. Further, no power loss occurs and no distortions are introduced into the signal.

The passive loudspeaker multiplexer according to the present invention has the advantage that almost an arbitrary number of loudspeakers may be connected to the multiplexer without requiring a manual adjustment of configuration settings. The setup of any speaker configuration is facilitated regardless of the total or individual impedance. Thus, the present invention provides a passive loudspeaker multiplexer that does not introduce any power loss, inefficiencies or distortions. Further, the passive loudspeaker multiplexer does not require an external power supply.

The passive loudspeaker multiplexer may comprise a second high pass that is connected between the input ports of the passive loudspeaker multiplexer. Thereby, the load connected to the amplifier can be more accurately defined.

The first high pass may comprise a first resistor and a second capacitor connected in series. The second high pass may comprise a second resistor and a third capacitor connected in series.

The output ports of the passive loudspeaker multiplexer may be connected to a plurality of output connectors, wherein the output connectors are connected in parallel to the output ports. Accordingly, a plurality of loudspeakers may be connected in parallel to the output ports via different connectors. It is to be understood that to each output connector a loudspeaker may be connected.

The first capacitor may be a polarized capacitor, preferably an electrolyte capacitor. Currently, polarized capacitors and electrolyte capacitors have a higher capacitance as compared to non-polarized capacitors.

The input ports may comprise a plus pole and a minus pole, and the output ports may comprise a plus pole and a minus pole. The first capacitor may be connected between the plus pole of the input ports and the plus pole of the output ports. In this case the positive electrode of the first capacitor is connected to the plus pole of the output ports. In the alternative, the first capacitor is connected between the minus pole of the amplifier and the minus pole of the output ports. The positive electrode of the first capacitor may be connected in this configuration to the minus pole of the input ports.

The first capacitor may have a capacitance that is larger than the capacitance of the capacitor of one channel of the power supply of the amplifier. The channel may be the right or left channel of a stereo amplifier. It is to be understood that in devices, such as Dolby surround systems, the amplifier may comprise a plurality of channels that comprises more than two channels.

The first capacitor may have a capacitance that is larger than approximately 20,000 μF.

Without wishing to be bound to a particular theory, the applicant assumes that the first capacitor acts as a powers storage that ensures that all parallel connected loudspeakers are supplied with power.

The first high pass may be configured such that its frequency response essentially equalizes the frequency response of the first capacitor. Thereby, an appropriate sound quality may be ensured. The first high pass and the second high pass may be configured such that their frequency response essentially equalizes the frequency response of the first capacitor.

The first capacitor may comprise a plurality of parallel connected capacitors. Without wishing to be bound to a particular theory, the applicant assumes that due to the parallel connection the parasitic resistances may be reduced resulting in a better performance of the passive loudspeaker multiplexer. The first capacitor may comprise a polarized capacitor and a non-polarized capacitor connected in parallel. Thereby, both high frequencies and low frequencies may be transmitted appropriately by the passive loudspeaker multiplexer.

The invention also discloses an amplifier comprising at least one passive loudspeaker multiplexer.

The invention also discloses a loudspeaker arrangement comprising a plurality of loudspeakers and at least one passive loudspeaker multiplexer.

The invention also discloses a loudspeaker switch comprising at least one passive loudspeaker multiplexer per channel. A loudspeaker switch for a stereo amplifier may comprise two channels, namely a right and left channel. A loudspeaker switch for a surround system may comprise five to seven or even more channels.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

BRIEF DESCRIPTION OF THE FIGURES OF THE DRAWINGS

FIGS. 3A-3C show test results of the present invention.

DETAILED DESCRIPTION OF THE INVENTION

Figure 1:
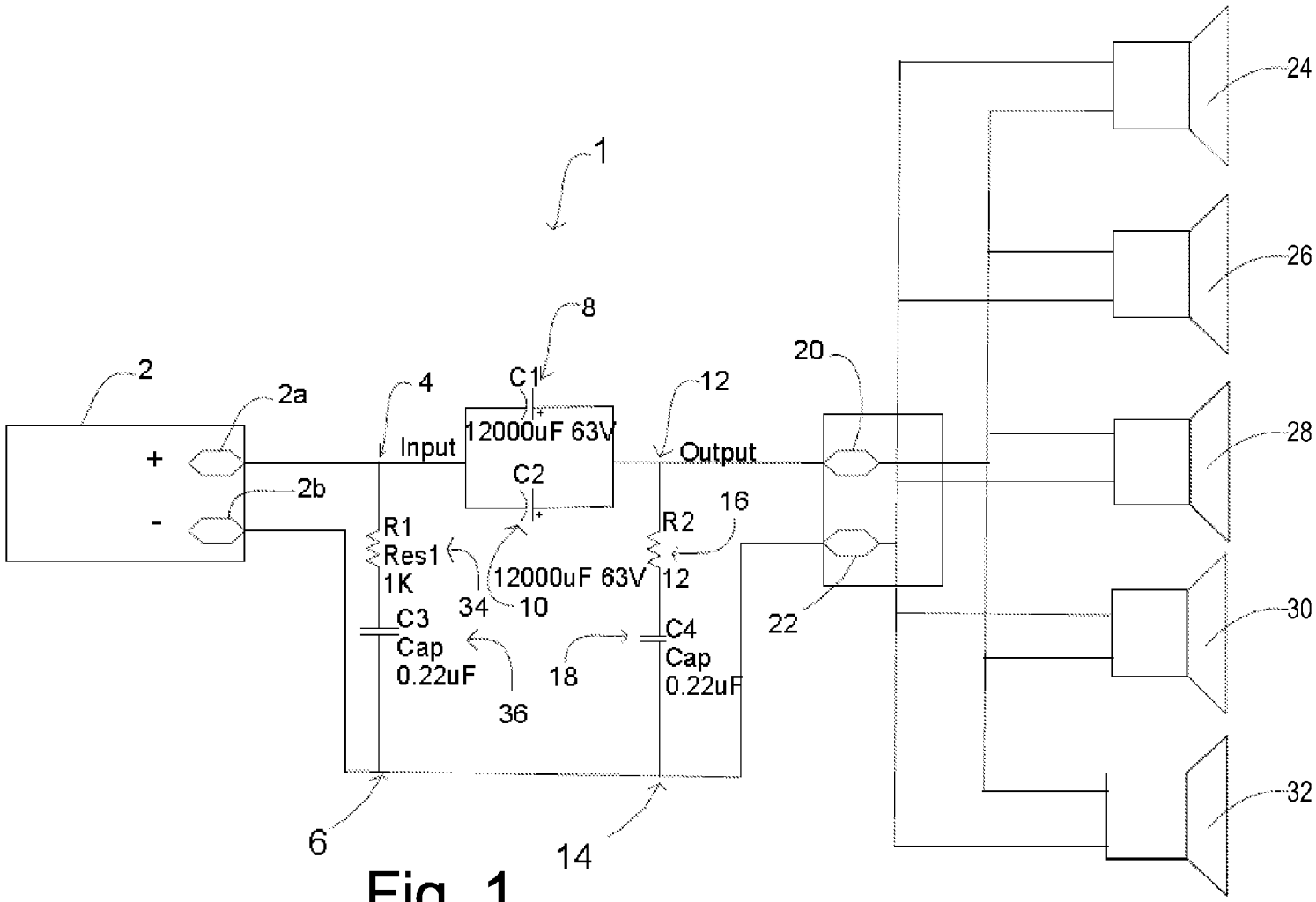
FIG. 1 shows a first embodiment of the present invention.

A preferred embodiment of the invention is now described in detail. Referring to the drawings, like numbers indicate like parts throughout the views. Unless otherwise specifically indicated in the disclosure that follows, the drawings are not necessarily drawn to scale. As used in the description herein and throughout the claims, the following terms take the meanings explicitly associated herein, unless the context clearly dictates otherwise: the meaning of "a," "an," and "the" includes plural reference, the meaning of "in" includes "in" and "on."

The invention is now described with reference to the drawings that depict exemplary and non-limiting embodiments.

FIG. 1 shows the first embodiment of the present invention. An amplifier 2 comprises a positive output 2*a* and a negative output 2*b*. The amplifier 2 may have an output power up to approximately 2800 W per channel corresponding to an output voltage of approximately 58 V RMS.

The output port of the amplifier 2*a* is connected to an input port for of the passive loudspeaker multiplexer 1. The negative output port 2*b* of the amplifier is connected to the second input port 6 of the passive loudspeaker multiplexer 1. Two first capacitors 8, 10 are connected between the first input port 4 and the first output port 12 of the passive loudspeaker multiplexer 1. The two first capacitors 8, 10 are connected in parallel. Each capacitor has a capacitance of 12,000 μF and a voltage rating of 63 V.

Between the output ports of the passive loudspeaker multiplexer a first resistor and a second capacitor are connected forming a first high pass. The first resistor 16 has a resistance of approximately 6Ω to approximately 20Ω, preferably approximately 11Ω to approximately 13Ω, most preferably approximately 12Ω. The second capacitor 18 has a value of approximately 0.15 μF to approximately 0.30 μF, preferably approximately 0.20 μF to 0.24 μF most preferably approximately 0.22 μF. This ensures an appropriate frequency response between 10 Hz to 40 kHz. The first high pass is configured such that the frequency response of the first capacitors 6, 10 is equalized such that the passive loudspeaker multiplexer 1 has an essentially linear frequency response and does not introduce any distortions.

Between the input ports 4, 6 of the passive loudspeaker multiplexer an optional second high pass is connected comprising a second resistor 34 and a third capacitor 36. The second resistor 34 has a resistance of approximately 500Ω to approximately 1500Ω, preferably approximately 750Ω to approximately 1250Ω, most preferably approximately 1 kΩ. The third capacitor 36 has a value of approximately 0.15 μF to approximately 0.30 μF, preferably approximately 0.20 μF to 0.24 μF, most preferably approximately 0.22 μF. This ensures an appropriate frequency response between 10 Hz to 40 kHz.

Particularly, the first high pass having the first resistor 12 and the second capacitor 18 acts to equalizes the frequency response of the first capacitors 8, 10. The second high pass comprising the second resistor 34 and the third capacitor 36 may also act to equalize the frequency response of the first capacitors 8, 10. Further, the second high pass may operate to provide a defined load to the output ports 2*a*, 2*b* of the amplifier 2.

To the output ports 20, 22 of the passive loudspeaker multiplexer 1 a plurality of loudspeakers 24-32 are connected. The loudspeakers may comprise a different power rating and operative frequency range. For example, loudspeaker 24 may be adapted to reproduce high frequencies, wherein another loudspeaker may be adapted to reproduce lower frequencies. It is to be understood that the frequency ranges reproduced by different loudspeakers 24 to 32 may overlap. All loudspeakers may reproduce essentially the entire frequency range that can be perceived by a human being or parts of such frequency range.

Without wishing to be bound to a particular theory, the inventor assumes that the first capacitance 8, 10 acts as a power storage supplying the loudspeakers 24-32 with electric power. Since the first capacitors 8, 10 act as a high pass, a first high pass comprising the first resistor 16 and the second capacitor 18 is connected between the output ports of the passive loudspeaker multiplexer in order to equalize the frequency response of the passive loudspeaker multiplexer 1.

Figure 2:
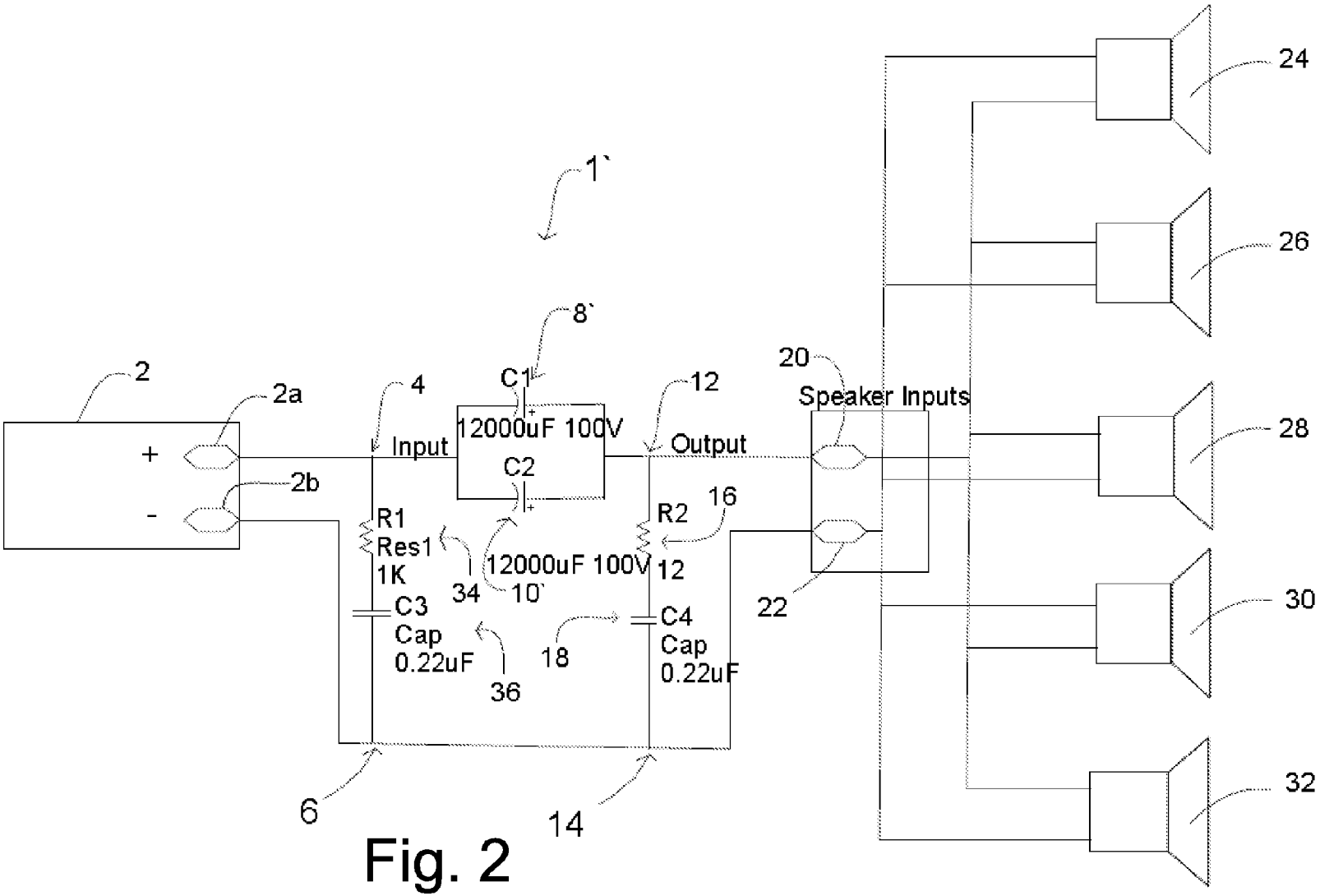
FIG. 2 shows a second embodiment according to the present invention.

FIG. 2 shows a passive loudspeaker multiplexer 1' according to the second embodiment. The amplifier 2' has a higher power rating namely up to approximately 4000 W per channel corresponding to an output voltage of approximately 94 V RMS. Accordingly, the voltage rating of the first capacitors 8', 10' has been changed to 100 V.

FIGS. 3*a* to 3*c* show measurement results of the inventive passive loudspeaker multiplexer 1, 1'. The first column on the left side denotes the output voltage of the amplifier in V without load. The second column denotes the output voltage of the amplifier in V with load. The third column represents the output current of the passive loudspeaker multiplexer. The fourth column denotes the frequency output by the amplifier. The fifth column represents the internal impedance of the amplifier. The right column represents the impedance at the output of the passive loudspeaker multiplexer.

FIG. 3*a* represents the case, where a load of 2Ω is connected to the amplifier 2, but no passive loudspeaker multiplexer 1, 1' is connected to the amplifier 2. FIG. 3*b* represents the case where a load of 2Ω is connected to the passive loudspeaker multiplexer 1, 1'. FIG. 3*c* shows the case, in which a load of 0.47Ω is connected to the outputs 20, 22 of the passive loudspeaker multiplexer.

It can be seen from the tables that the internal impedance of the amplifier does not change although the impedance of the load changes significantly. Further, the current supplied by the amplifier changes significantly due to the load. However, the output voltage of the amplifier does not change, although the load changes significantly. Thereby, it can be prevented that the amplifier enters protection mode or switches off for any other reason.

Figure 4:
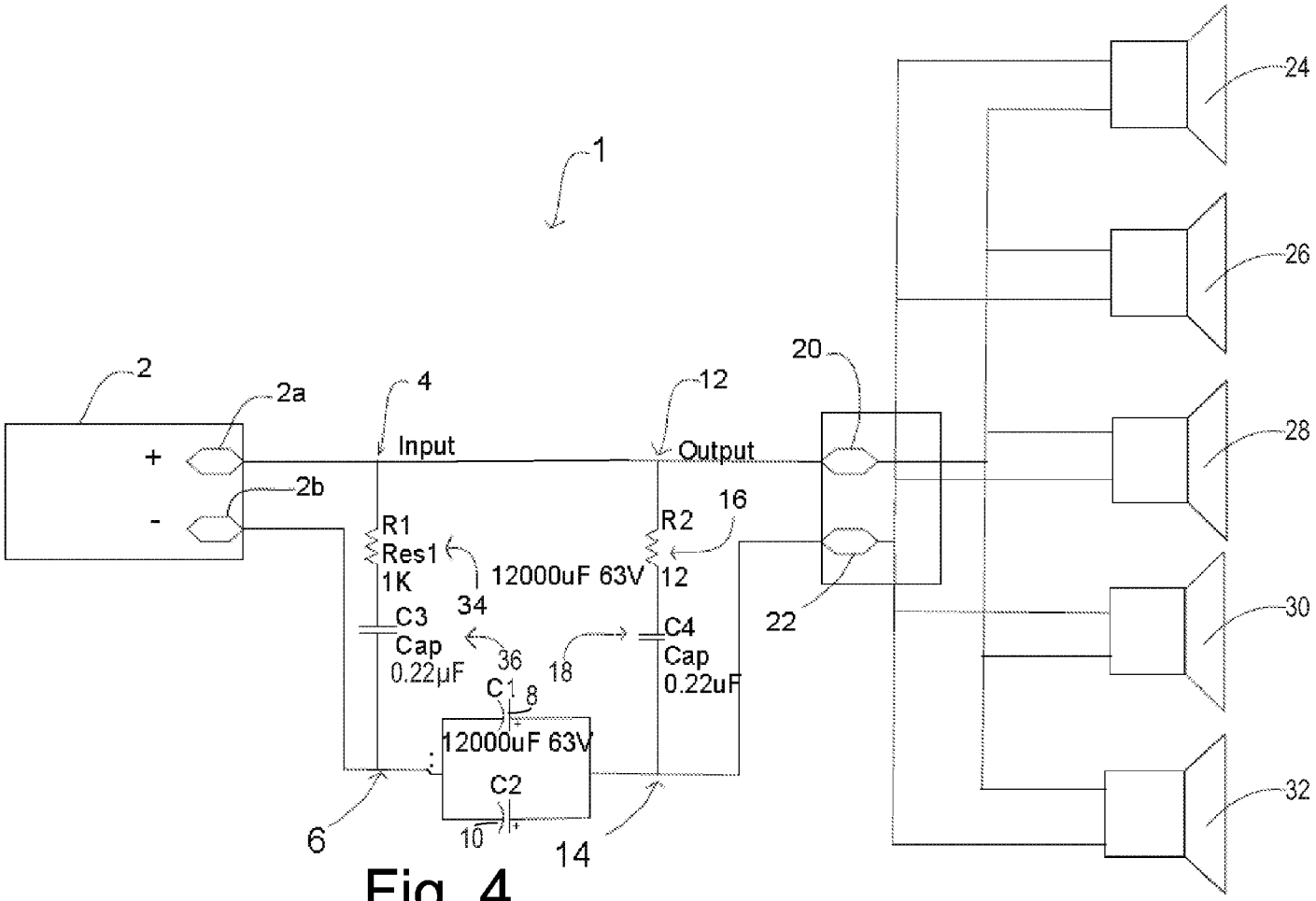
FIG. 4 shows a second embodiment of the present invention.

As shown in FIG. 4, in one embodiment, the first capacitor 8, 10 is interconnected between the minus pole 2*b* of the amplifier and the minus pole 22 of the output ports and the positive electrode of the first capacitor 8, 10 is connected to the minus pole 2*b* of the input ports.

The above described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A passive loudspeaker multiplexer adapted to be interconnected between an amplifier and a plurality of loudspeakers, comprising:

two input ports of the passive loudspeaker multiplexer adapted to be connected to two output ports of the amplifier;

two output ports of the passive loudspeaker multiplexer adapted to be connected to two input ports of the plurality of loudspeakers such that each of the plurality of loudspeakers is connected in parallel to the output ports of the passive loudspeaker multiplexer;

at least one first capacitor connected between a first input port and a first output port of the passive loudspeaker multiplexer; and a first high pass filter connected between the two output ports of the passive loudspeaker multiplexer;

wherein the first capacitor has a capacitance larger than a capacitance of a capacitor of a power supply of the amplifier; and wherein the output ports of the passive loudspeaker multiplexer are connected to a plurality of output connectors and wherein the output connectors are connected in parallel to the output ports of the passive loudspeaker multiplexer and to each output connector of each of the plurality of loudspeakers.

2. The passive loudspeaker multiplexer according to claim 1, wherein a second high pass filter is connected between the input ports of the passive loudspeaker multiplexer.

3. The passive loudspeaker multiplexer according to claim 2, wherein the first high pass filter comprises a first resistor and a second capacitor connected in series and/or wherein the second high pass filter comprises a second resistor and a third capacitor connected in series.

4. The passive loudspeaker multiplexer according to claim 2, wherein the first high pass and second high pass filters are configured such that their frequency responses essentially equalizes the frequency response of the first capacitor.

5. The passive loudspeaker multiplexer according to any one of claim 1, wherein the first capacitor is a polarized capacitor, preferably an electrolyte capacitor.

6. The passive loudspeaker multiplexer according to claim 5, wherein the input ports of the passive loudspeaker multiplexer comprise a plus pole and a minus pole, and the output ports of the passive loudspeaker multiplexer comprise a plus pole and a minus pole, and wherein the first capacitor is interconnected between the plus pole of the input ports and the plus pole of the output ports of the passive loudspeaker multiplexer and the positive electrode of the first capacitor is connected to the plus pole of the output ports of the passive loudspeaker multiplexer.

7. The passive loudspeaker multiplexer according to claim 5, wherein the input ports comprise a plus pole and a minus pole, and the output ports comprise a plus pole and a minus pole, and wherein the first capacitor is interconnected between the minus pole of the amplifier and the minus pole of the output ports and the positive electrode of the first capacitor is connected to the minus pole of the input ports.

8. The passive loudspeaker multiplexer according to claim 1, wherein the first capacitor has a capacitance larger than approximately 20000 μF.

9. The passive loudspeaker multiplexer according to claim 1, wherein the first high pass filter is configured such that its frequency response essentially equalizes the frequency response of the first capacitor.

10. The passive loudspeaker multiplexer according to claim 1, wherein the first capacitor comprises a plurality of parallel connected capacitors.

11. An amplifier comprising at least one passive loudspeaker multiplexer according to claim 1.

12. A loudspeaker arrangement comprising a plurality of loudspeakers and at least one passive loudspeaker multiplexer according to claim 1.

13. A loudspeaker switch comprising one passive loudspeaker multiplexer according to claim 1 per channel.

* * * * *